US007997762B2

(12) United States Patent
Wang et al.

(10) Patent No.: US 7,997,762 B2
(45) Date of Patent: Aug. 16, 2011

(54) LIGHT-GUIDING MODULES AND LED LAMP USING THE SAME

(75) Inventors: Zhong-Qing Wang, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 196 days.

(21) Appl. No.: 12/406,088

(22) Filed: Mar. 17, 2009

(65) Prior Publication Data

US 2009/0323337 A1 Dec. 31, 2009

(30) Foreign Application Priority Data

Jun. 25, 2008 (CN) ..... 2008 1 0068108

(51) Int. Cl.
*F21V 21/00* (2006.01)

(52) U.S. Cl. ..... 362/249.02; 362/237; 362/241; 362/290; 362/292; 362/354; 362/342

(58) Field of Classification Search ..... 362/290–293, 362/422, 342, 325, 354, 249.02, 241, 237
See application file for complete search history.

(56) References Cited

U.S. PATENT DOCUMENTS 5,268,828 A * 12/1993 Miura ..... 362/249.06
7,284,881 B2 * 10/2007 Kim et al. ..... 362/290
7,455,429 B2 * 11/2008 Barker ..... 362/290
7,520,643 B2 * 4/2009 Caferro ..... 362/342

* cited by examiner

*Primary Examiner* — Robert May
(74) *Attorney, Agent, or Firm* — Frank R. Niranjan

(57) ABSTRACT

An LED lamp includes a base, an LED module having a plurality of LEDs mounted on a top of the base, and a light-guiding module fixed on the LED module. The light-guiding module includes a plurality of mounted plates and a plurality of inserted plates intersecting and engaging the mounted plates. The mounted plates and the inserted plates cooperatively define a plurality of cavities to receive corresponding LEDs therein for guiding and reflecting light generated by the corresponding LED in a predetermined manner.

19 Claims, 3 Drawing Sheets

LIGHT-GUIDING MODULES AND LED LAMP USING THE SAME

BACKGROUND OF THE DISCLOSURE

1. Field of the Disclosure

The disclosure relates to LED (light emitting diode) lamps and, more particularly, to an LED lamp using light-guiding modules.

2. Description of Related Art

An LED lamp is a type of solid-state lighting that utilizes LEDs as a source of illumination. LEDs convert electricity to light via current through a junction region comprising two different semiconductors, by which electrons and holes coupled at the junction region generate the light. LED advantages of resistance to impact and nearly limitless lifetime under specific conditions make an LED lamp a cost-effective yet high quality replacement for incandescent and fluorescent lamps.

Known implementations of LED modules in an LED lamp use a plurality of individual LEDs to generate light reflected by a light-guiding module to obtain sufficient illumination of suitably wide distribution. A conventional light-guiding module is integrally fabricated and suited only for use in the type of LED lamp for which its use is intended, such that in order to equip a variety of LED lamps, custom development and manufacture of a wide range of light-guiding module types are required, representing considerable cost and material burdens.

What is needed, therefore, is a light-guiding module compatible with a variety of LED lamp types, thereby overcoming the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE DISCLOSURE

Figure 1:
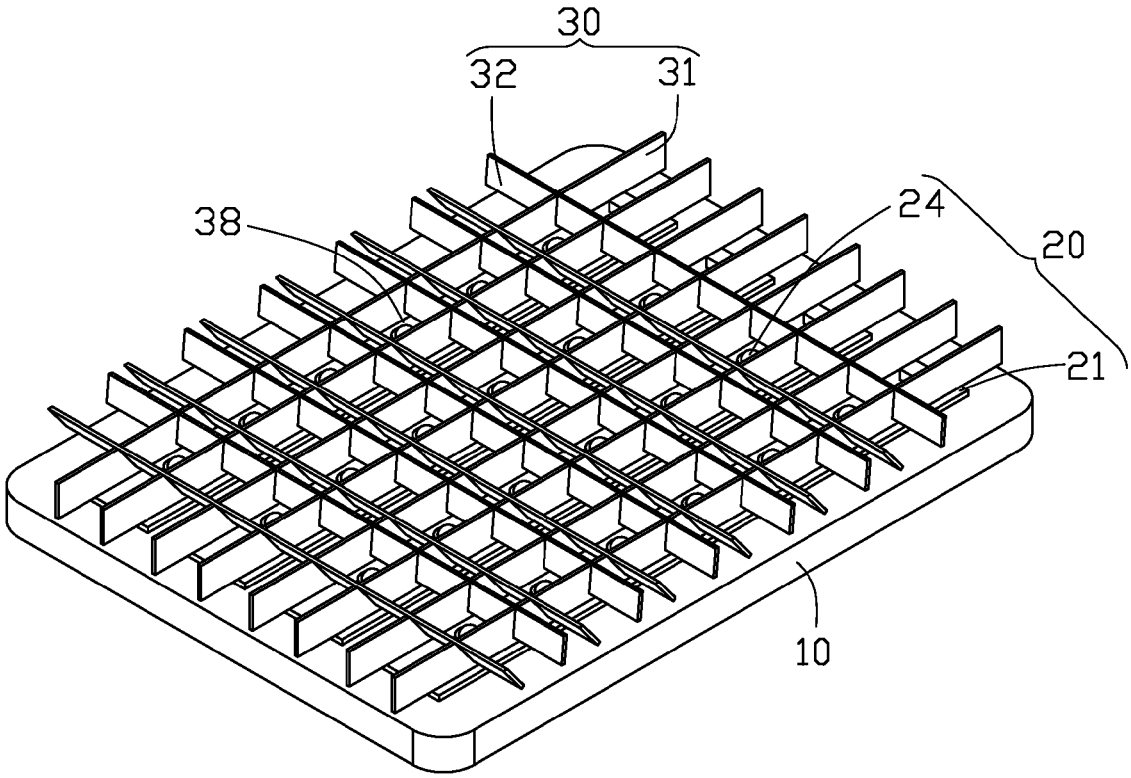
FIG. 1 is an isometric, assembled view of an LED lamp in accordance with an embodiment of the present disclosure.
Figure 2:
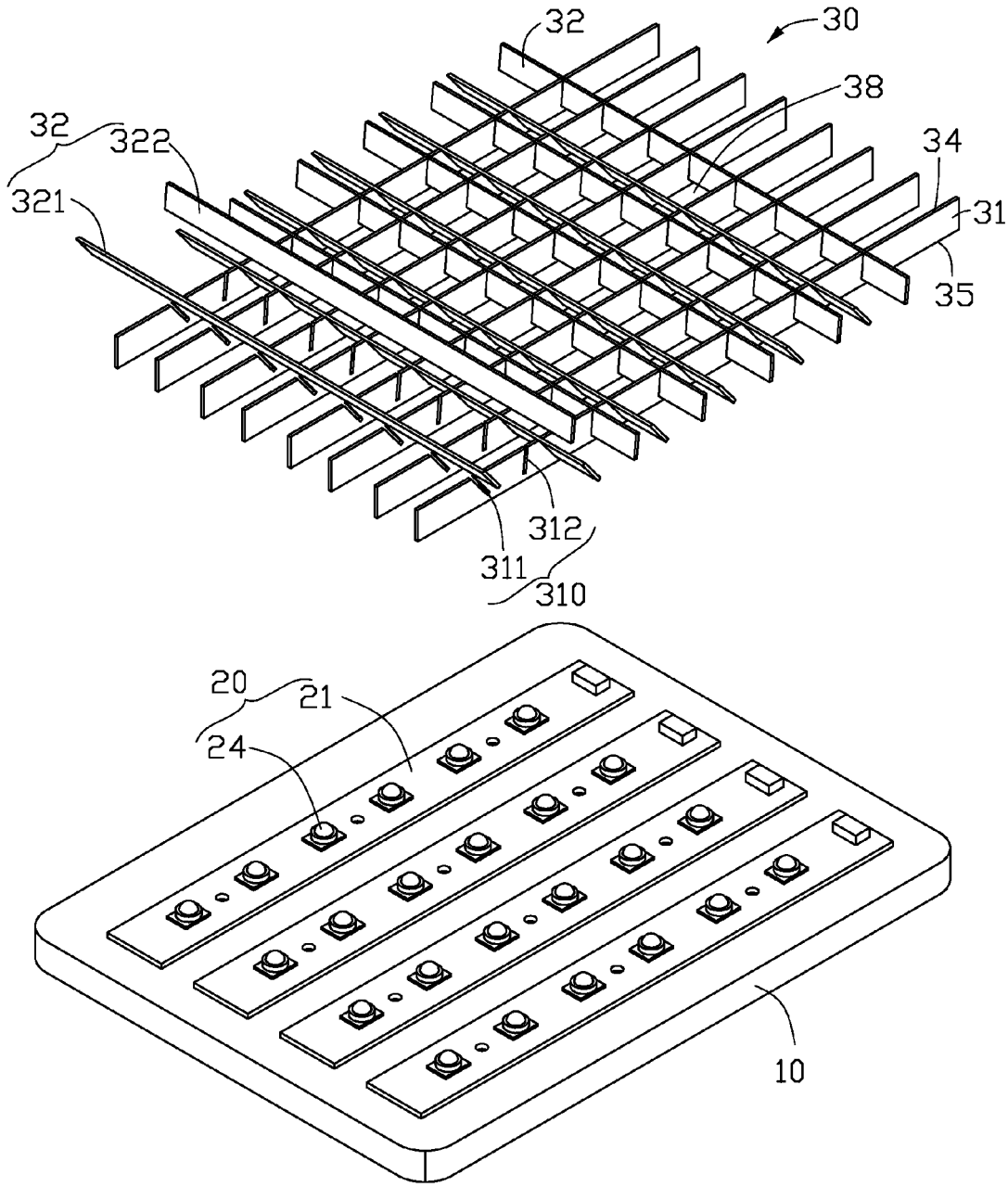
FIG. 2 is an exploded view of the LED lamp of FIG. 1.

Referring to FIGS. 1-2, an LED lamp in accordance with an embodiment is illustrated. The LED lamp comprises a base 10, an LED module 20 mounted on the base 10 and a light-guiding module 30 fixed to a top of the LED module 20.

The base 10 is integrally made of a metal with good heat conductivity such as copper or aluminum to dissipate heat generated by the LED module 20. The base 10 is rectangular. Alternatively, the base 10 can extend fins (not shown) from a bottom surface opposite to the LED module 20.

The LED module 20 comprises four elongated printed circuit boards 21 mounted lengthways on the base 10 and a plurality of spaced LEDs 24 evenly mounted on top sides of the printed circuit boards 21. The LEDs 24 of each printed circuit board 21 are arranged along a central axis thereof. The LEDs 24 of all printed circuit boards 21 are distributed on the base 10 in matrix.

The light-guiding module 30 comprises a plurality of lengthways mounted plates 31 and a plurality of transverse inserted plates 32 engaging the mounted plates 31. Each mounted plate 31 is elongated and rectangular. The mounted plates 31 are secured and stand on two long sides of each of the printed circuit boards 21. The mounted plates 31 extend outwardly at 3-5° relative to a vertical direction of a top surface of each printed circuit board 21.

Figure 3:
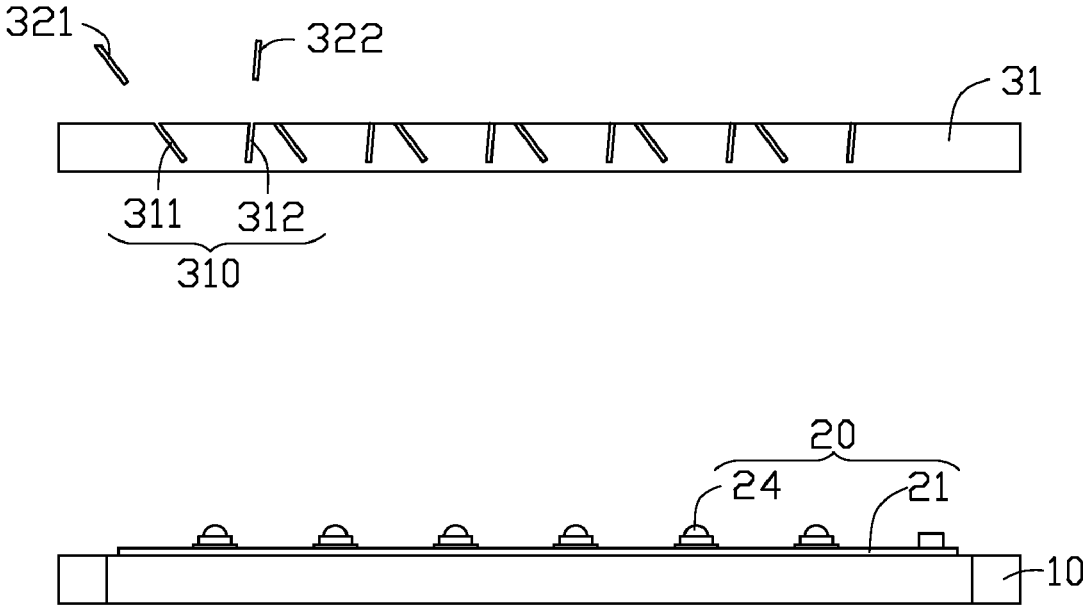
FIG. 3 is a side view of the LED lamp of FIG. 2.

Referring also to FIG. 3, each mounted plate 31 has a top edge 34 and a bottom edge 35 opposite to the top edge 34. Each mounted plate 31 defines a plurality of slit sets 310. Each slit set 310 includes a straight first slit 311 and a straight second slit 312. The first and second slits 311, 312 extend through the top edge 34 of each mounted plate 31 and are defined at a distance from the bottom edge 35 thereof. The first slits 311 of the slit sets 310 are parallel, and the second slits 312 of the slit sets 310 are parallel. The first and second slits 311, 312 extend downwardly from the top edge 34 toward each other. The first slit 311 of each slit set 310 angles about 50° downwardly and rightward from the top edge 34, and the second slit 312 of each slit set 310 angles about 87° downwardly and leftward from the top edge 34. Thus, a distance between top ends of the first slit 311 and the second slit 312 of each slit set 310 exceeds that between bottom ends thereof. In other words, each slit set 310 has an upper portion in an approximately "V" shape. Alternatively, the angle between the second slit 312 and the top edge 34 can be defined as the same as that between the first slit 311 and the top edge 34.

The inserted plates 32 are divided into a plurality of first inserted plates 321 and a plurality of second inserted plates 322. Each first inserted plate 321 intersects all of the mounted plates 31. Each of the second inserted plates 322 intersects all of the mounted plates 31. The first and second inserted plates 321, 322 are intimately received in the corresponding first and second slits 311, 312 of the mounted plates 31, respectively. After assembly of the light-guiding module 30, the mounted plates 31 and inserted plates 32 cooperatively define a plurality of receiving cavities 38 corresponding to the LEDs 24. Each of the cavities 38 is encircled by two neighboring mounted plates 31, a first inserted plate 321 and a second inserted plate 322. Each cavity 38 receives a corresponding LED 24 therein reflecting and guiding light generated by the LED 24. Thus, an inner surface of the cavities 38 acts as a reflecting surface to reflect and guide light generated by the LEDs 24.

Each cavity 38 has a rectangular upper opening (not labeled) and a rectangular lower opening. Since the first and second inserted plates 321, 322 received in the first and second slits 311, 312 of the mounted plates 31 angle upwardly, the lower opening is smaller than the upper opening. The lower openings of the cavities 38 are in alignment and directly face corresponding LEDs 24 of the LED module 20. The amount of cavities 38 of the light-guiding module 30 is determined by the amount of mounted plates 31 and inserted plates 32 and lengths thereof. To satisfy a requirement for a variety of LED modules 20 of the LED lamp, the amount of the mounted plates 31 and the inserted plates 32 and lengths thereof can be adjusted to define an amount of cavities 38 corresponding to the LEDs 24 to reflect light generated by the LEDs 24.

According to the disclosure, the mounted plates 31 and the inserted plates 32 form the light-guiding module 30, allowing the LED module 20 of the disclosed embodiment to conform to varying types of LED modules in different LED lamps. Furthermore, manufacture of the light-guiding module 30 requires only simple materials, avoiding the expense of mold casting, thereby significantly reducing manufacturing costs of the lamp.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An LED lamp, comprising a base;

an LED module mounted on a top of the base, the LED module comprising a plurality of LEDs; and a light-guiding module fixed on the LED module, the light-guiding module comprising a plurality of mounted plates and a plurality of inserted plates intersecting and detachably engaging with the mounted plates, the mounted plates and the inserted plates cooperatively defining a plurality of cavities receiving a corresponding LED therein, each of the cavities being encircled by two neighboring mounted plates and two neighboring inserted plates, the mounted plates and the inserted plates cooperatively guiding and reflecting light generated by the corresponding LEDs in a predetermined manner.

2. The LED lamp as claimed in claim 1, wherein each cavity comprises an upper opening and a lower opening in communication with the upper opening, each lower opening aligning with and directly facing the corresponding LED of the LED module.

3. The LED lamp as claimed in claim 2, wherein the lower opening is smaller than the upper opening.

4. The LED lamp as claimed in claim 1, wherein each of the mounted plates defines a plurality of slit sets receiving the inserted plates therein.

5. The LED lamp as claimed in claim 4, wherein each of the slit sets comprises a first slit and a second slit, the first and second slits extending downwardly towards the LEDs from a top edge of each mounted plate toward each other.

6. The LED lamp as claimed in claim 5, wherein the first slit of each slit set angles at an acute angle downwardly and rightward from the top edge.

7. The LED lamp as claimed in claim 5, wherein the second slit of each slit forms angle larger than that of the first slit downwardly and leftward from the top edge.

8. The LED lamp as claimed in claim 5, wherein bottom ends of the first and second slits are defined at a distance from a bottom edge of each mounted plate.

9. The light-guiding module as claimed in claim 1, wherein each of the mounted plates and the inserted plates is a single flat plate.

10. The light-guiding module as claimed in claim 9, wherein each of the inserted plates crosses each of the mounted plates.

11. A light-guiding module fixed on an LED module to guide and reflect light emitted by a plurality of LEDs of the LED module, comprising:

a plurality of mounted plates; and a plurality of inserted plates intersecting and engaging with the mounted plates, the mounted plates and the inserted plates cooperatively defining a plurality of cavities each receiving a corresponding LED therein, each of the cavities being encircled by two neighboring mounted plates and two neighboring inserted plates, the mounted plates and the inserted plates cooperatively guiding and reflecting light generated by the corresponding LED in a predetermined manner, each of the cavities comprising an upper opening and a lower opening in communication with the upper opening.

12. The light-guiding module as claimed in claim 11, wherein the amount of cavities varies with the amount of mounted plates and inserted plates.

13. The light-guiding module as claimed in claim 11, wherein the lower opening is smaller than the upper opening.

14. The light-guiding module as claimed in claim 11, wherein each of the mounted plates defines a plurality of slit sets receiving the inserted plates therein.

15. The light-guiding module as claimed in claim 14, wherein the second slit of each slit set angles about 87° downwardly and leftward from the top edge.

16. The light-guiding module as claimed in claim 14, wherein each of the slit sets comprises a first slit and a second slit, the first and second slits extending downwardly from a top edge of each mounted plate toward each other.

17. The light-guiding module as claimed in claim 14, wherein the first slit of each slit set angles about 50° downwardly and rightward from the top edge.

18. The light-guiding module as claimed in claim 11, wherein each of the inserted plates crosses each of the mounted plates.

19. The light-guiding module as claimed in claim 18, wherein each of the mounted plates and the inserted plates is a single flat plate.

* * * * *